US009552950B2

(12) United States Patent
Babu et al.

(10) Patent No.: US 9,552,950 B2
(45) Date of Patent: Jan. 24, 2017

(54) RETAINING ASSEMBLY FOR A CIRCUIT BREAKER CONTACT SYSTEM

(71) Applicant: GENERAL ELECTRIC COMPANY, Schenectady, NY (US)

(72) Inventors: Triplicane Gopikrishnan Babu, Hyderabad (IN); Rajendra Kumar Sharma, Hyderabad (IN); Tanmay Pralhad Tamboli, Hyderabad (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/736,474

(22) Filed: Jun. 11, 2015

(65) Prior Publication Data

US 2016/0365212 A1 Dec. 15, 2016

(51) Int. Cl.

| | |
|---|---|
| ***H01H 1/00*** | (2006.01) |
| ***H01H 71/10*** | (2006.01) |
| ***H01H 3/38*** | (2006.01) |
| ***H01H 9/20*** | (2006.01) |
| ***H01H 33/08*** | (2006.01) |
| ***H01H 83/20*** | (2006.01) |

(52) U.S. Cl.

CPC ..... *H01H 71/1009* (2013.01); *H01H 3/38* (2013.01); *H01H 9/20* (2013.01); *H01H 33/08* (2013.01); *H01H 83/20* (2013.01); *H01H 2205/002* (2013.01); *H01H 2235/01* (2013.01)

(58) Field of Classification Search

CPC ..... H01H 71/1009; H01H 3/38; H01H 9/20; H01H 33/08; H01H 83/20; H01H 2205/002; H01H 2235/01

USPC ..... 200/318, 323–324, 327, 400; 218/154

See application file for complete search history.

(56) References Cited

U.S. PATENT DOCUMENTS

| | | | |
|---|---|---|---|
| 2,833,886 | A | 5/1958 | Goodwin |
| 3,192,344 | A | 6/1965 | Cole |
| 3,518,587 | A | 6/1970 | Huggins |

(Continued)

FOREIGN PATENT DOCUMENTS

| | | | |
|---|---|---|---|
| SE | 175730 | C1 | 6/1961 |

OTHER PUBLICATIONS

Ex Parte Quayle Action towards related U.S. Appl. No. 14/740,545 dated Sep. 16, 2016.

(Continued)

*Primary Examiner* — Edwin A. Leon

(74) *Attorney, Agent, or Firm* — GE Global Patent Operation; Stephen G. Midgley

(57) ABSTRACT

A moveable contact arm assembly includes a moveable contact arm having a moveable contact thereon. Also included is a carrier assembly operatively coupled to the moveable contact arm. Further included is a first end plate operatively coupled to the carrier assembly and a bottom bracket operatively coupled to the first end plate. Yet further included is a first latch member coupled to the bottom bracket, the first latch member comprising a first guiding surface and defining a first recess portion. Also included is a guide pin extending from the carrier assembly and in contact with the first guiding surface of the first latch member during movement of the moveable contact arm assembly. Also included is a first stop pin extending from the carrier assembly and disposed in the first recess portion of the first latch member in the blow open condition of the circuit breaker.

17 Claims, 3 Drawing Sheets

(56) References Cited

U.S. PATENT DOCUMENTS

| | | | | |
|---|---|---|---|---|
| 4,144,513 | A | 3/1979 | Shaffer et al. | |
| 4,251,702 | A | 2/1981 | Castonguay et al. | |
| 4,281,303 | A | 7/1981 | Heft | |
| 4,524,339 | A | 6/1985 | Chabot | |
| 4,611,187 | A | 9/1986 | Banfi | |
| 4,618,745 | A | 10/1986 | Thompson, III | |
| 5,363,076 | A | 11/1994 | Miller et al. | |
| 5,424,701 | A | 6/1995 | Castonguay et al. | |
| 5,534,674 | A | 7/1996 | Steffens | |
| 5,731,560 | A | 3/1998 | Nebon et al. | |
| 5,793,270 | A | 8/1998 | Beck et al. | |
| 5,912,605 | A | 6/1999 | Eberts | |
| 5,931,290 | A | 8/1999 | Wehrli, III et al. | |
| 6,015,959 | A * | 1/2000 | Slepian et al. ..... | H01H 3/3015 200/400 |
| 6,069,544 | A | 5/2000 | Seymour et al. | |
| 6,072,136 | A * | 6/2000 | Wehrli, III et al. . | H01H 3/3015 200/400 |
| 6,180,902 | B1 * | 1/2001 | Kowalyshen et al. ... | H01H 3/30 200/400 |
| 6,326,868 | B1 | 12/2001 | Kranz et al. | |
| 6,437,670 | B1 | 8/2002 | Castonguay et al. | |
| 7,034,642 | B1 | 4/2006 | Rakus et al. | |
| 7,115,830 | B1 * | 10/2006 | Weister et al. ..... | H01H 3/3031 200/400 |
| 7,368,677 | B2 * | 5/2008 | Jones et al. ..... | H01H 3/3031 200/400 |
| 7,566,840 | B2 | 7/2009 | Sudhakar et al. | |
| 7,633,031 | B2 | 12/2009 | Wehrli, III et al. | |
| 8,507,817 | B2 | 8/2013 | Gottschalk et al. | |
| 2008/0257702 | A1 | 10/2008 | Weister et al. | |
| 2009/0072933 | A1 | 3/2009 | Bonetti et al. | |
| 2009/0128265 | A1 | 5/2009 | Sudhakar et al. | |
| 2015/0311009 | A1 | 10/2015 | Ding et al. | |

OTHER PUBLICATIONS

EP Search Report issued from corresponding EP Application No. 16173283.9 dated Oct. 17, 2016.

A European Search Report and Opinion issued in connection with related EP Application No. 16173873.7 on Nov. 9, 2016.

* cited by examiner

RETAINING ASSEMBLY FOR A CIRCUIT BREAKER CONTACT SYSTEM

BACKGROUND OF THE DISCLOSURE

The subject matter disclosed herein relates to circuit breakers and, more particularly, to a retaining assembly of a circuit breaker contact system.

An electrical switching apparatus, such as a circuit breaker, provides protection for electrical systems from electrical fault conditions such as, for example, current overloads, short circuits, abnormal voltage and other fault conditions. Typically, circuit breakers include a housing and an operating mechanism which opens separable electrical contacts to interrupt the flow of current through the conductors of an electrical system in response to certain fault conditions.

To maintain a breaker withstand current rating, the contacts must be maintained in a closed condition at the current withstand rating. On the other hand, the short circuit let-through current must be capable of opening the contacts quickly during a high short circuit condition. Opening of the contacts during a short circuit event involves movement of a carrier assembly, to which moveable contact arms are coupled, at a velocity that may be sufficient to lead to a rebounding of the carrier assembly subsequent to impact with a stopper terminal. Such a rebound effect presents the possibility of a "restrike" of the contacts, which in turn damages the contacts. Therefore, dampening or eliminating the rebound of the carrier assembly would be advantageous.

BRIEF DESCRIPTION OF THE DISCLOSURE

According to one aspect of the disclosure, a retaining assembly of a circuit breaker contact system includes a fixed contact. Also included is at least one moveable contact arm assembly comprising a moveable contact arm having a moveable contact thereon and moveable with the moveable contact arm, the moveable contact arm moveable to position the moveable contact into engagement with the fixed contact to define a closed condition and out of engagement with the fixed contact to define a blow open condition. Further included is a carrier assembly operatively coupled to the moveable contact arm. Yet further included is a first end plate operatively coupled to the carrier assembly. Also included is a bottom bracket operatively coupled to the first end plate. Further included is a first latch member pivotably coupled to the bottom bracket, the first latch member comprising a first guiding surface and defining a first recess portion. Yet further included is a guide pin operatively coupled to, and extending from, the carrier assembly, the guide pin in contact with the first guiding surface of the first latch member during movement of the moveable contact arm assembly from the closed condition to the blow open condition. Also included is a first stop pin operatively coupled to, and extending from, the carrier assembly, the first stop pin disposed in the first recess portion of the first latch member in the blow open condition of the circuit breaker.

According to another aspect of the disclosure, a circuit breaker having a mechanism portion, a contact system portion and an arc chamber portion, the circuit breaker includes a plurality of fixed contacts. Also included is a moveable contact arm assembly comprising a plurality of moveable contact arms, each of the plurality of moveable contact arms having a moveable contact disposed thereon and moveable with the plurality of moveable contact arms, the moveable contact arm moveable to position each moveable contact into engagement with a respective fixed contact of the plurality of fixed contacts to define a closed condition and out of engagement with the plurality of fixed contacts to define a blow open condition. Further included is a carrier assembly operatively coupling the plurality of moveable contact arms to each other, the carrier assembly comprising a plurality of separation brackets operatively coupled to each other, each of the plurality of separation brackets disposed adjacent at least one of the plurality of moveable contact arms. Yet further included is a first end plate operatively coupled to a first side of the carrier assembly. Also included is a second end plate operatively coupled to a second side of the carrier assembly. Further included is a bottom bracket operatively coupled to the first end plate and the second end plate. Yet further included is a first latch member pivotably coupled to the bottom bracket, the first latch member comprising a first guiding surface and defining a first recess portion. Also included is a guide pin operatively coupled to, and extending away from, the first side of the carrier assembly, the guide pin in contact with the first guiding surface of the first latch member during movement of the moveable contact arm assembly from the closed condition to the blow open condition. Further included is a first stop pin operatively coupled to, and extending away from, the first side of the carrier assembly, the first stop pin disposed in the first recess portion of the first latch member in the blow open condition of the circuit breaker. Yet further included is a second latch member pivotably coupled to the bottom bracket, the second latch member comprising a second guiding surface and defining a second recess portion. The guide pin is operatively coupled to, and extends away from, the second side of the carrier assembly, the guide pin in contact with the second guiding surface of the second latch member during movement of the moveable contact arm assembly from the closed condition to the blow open condition. Also included is a second stop pin operatively coupled to, and extending away from, the second side of the carrier assembly, the second stop pin disposed in the second recess portion of the second latch member in the blow open condition of the circuit breaker to prevent movement of the moveable contact arm assembly toward the closed condition.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

BRIEF DESCRIPTION OF THE DISCLOSURE

Figure 1:
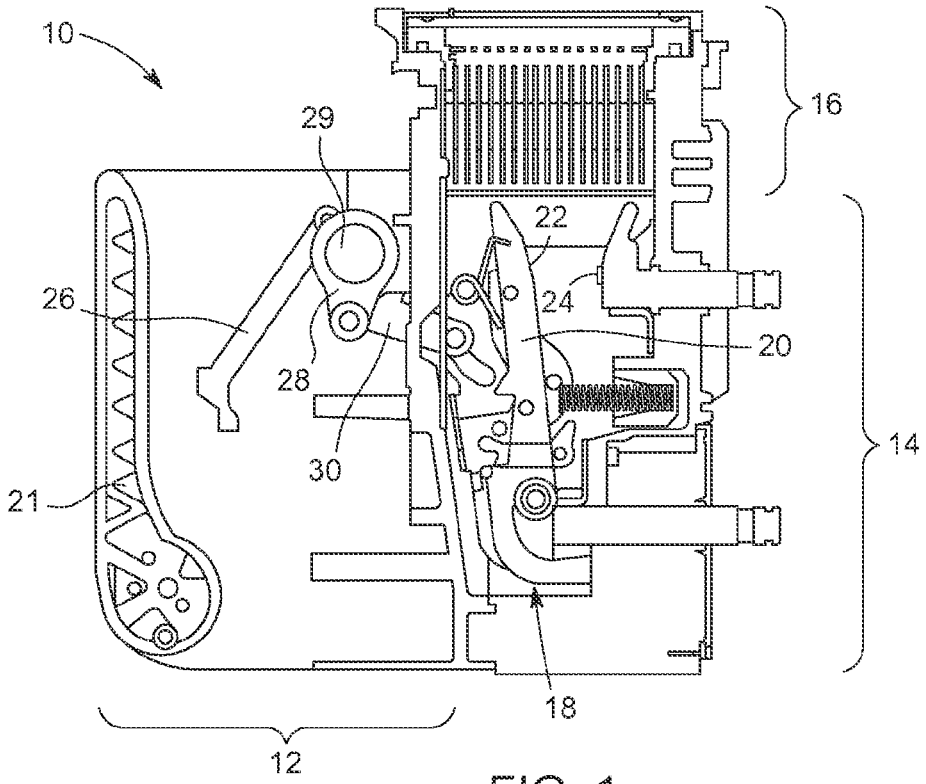
FIG. 1 is a side plan view of a circuit breaker.

Referring to FIG. 1, a circuit breaker is illustrated and generally referenced with numeral 10. The circuit breaker includes a main mechanism portion 12, a contact system portion 14, and an arc chute portion 16. The contact system portion 14 includes a moveable contact arm assembly 18 that includes at least one, but typically a plurality of moveable contact arms 20. Each of the moveable contact arms 20 includes a moveable contact 22 disposed thereon and is positioned to be moved into an out of contact with a respective fixed contact 24. The connection facilitates connecting and disconnecting an electrical power source to an electrical load. Specifically, the circuit breaker 10 is said to be in a closed condition when the moveable contact 22 and the fixed contact 24 are in contact. Conversely, the circuit breaker 10 is said to be in an "blow open condition" when the moveable contact 22 and the fixed contact 24 are not in contact and spaced from each other. The blow open condition occurs in response to a short circuit event. More particularly, a threshold electromagnetic force created by a short circuit forces the contact arm(s) to swing open before the mechanism 12 has time to respond. The threshold electromagnetic force is related to a threshold current level. In the blow open condition, a lay shaft 29 remains in a first rotational position that it is in during the closed condition described above. Upon activation of the mechanism 12 in response to a fault condition other than a short circuit event or subsequent to the blow open condition occurring, a resetting spring around the lay shaft 29 aids in moving a carrier assembly (described in detail below), to a fully open condition. This condition may be referred to as a "trip condition." It is to be appreciated that the trip open condition is distinct from the blow open condition. Movement to the trip condition involves the tripping system in the mechanism being activated and rotating the lay shaft 29 to bring the carrier assembly into the fully open condition.

When referring to movement of the moveable contact arm assembly 18 to the fully open condition, this is done by the mechanism 12. Several components are involved in this actuation, with a drive link 26 being operatively coupled to a first coupling member 28 which is rotatable about a lay shaft 29, the first coupling member 28 operatively coupled to a second coupling member 30. The coupling relationship between the second coupling member 30 and the moveable contact arm assembly 18 will be described in detail below.

When referring to movement of the moveable contact arm assembly 18 to the blow open condition in response to a short circuit event, this occurs due to imposition of an electrodynamic force over a threshold level. It is desirable to force the circuit breaker 10 into the blow open condition in as short of a time period as possible. However, an electrodynamic field is present during operation of the circuit breaker, thereby imposing electrodynamic forces on the moveable contact(s) 22 and fixed contact(s) 24, but it is also desirable to retain the contacts together during forces below the aforementioned threshold level. The embodiments described herein facilitate desired retention of the contacts, while also providing a more rapid response time to a short circuit condition to quickly move the circuit breaker into the blow open condition.

Figure 2:
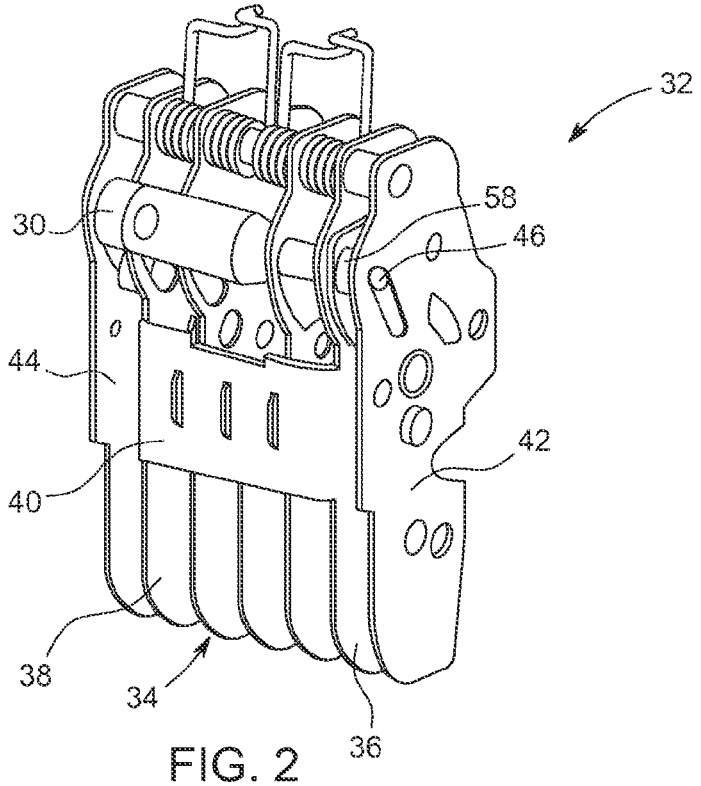
FIG. 2 is a partial perspective view of a carrier assembly of the circuit breaker.
Figure 4:
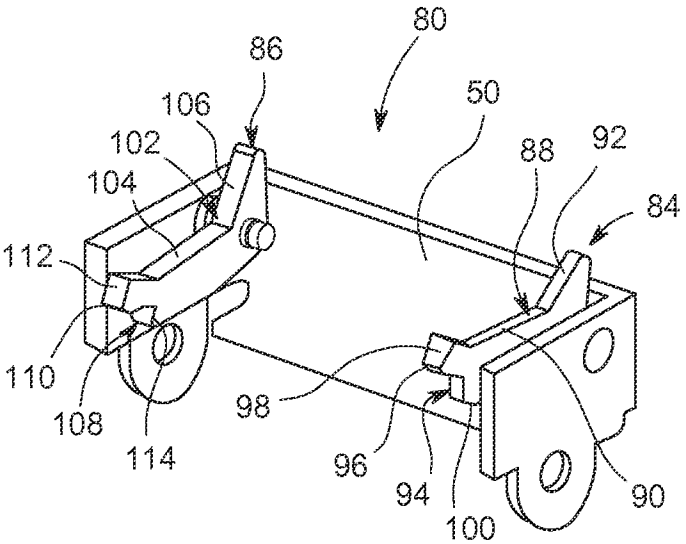
FIG. 4 is a perspective view of a bottom bracket and associated latches of the retaining assembly.
Figure 3:
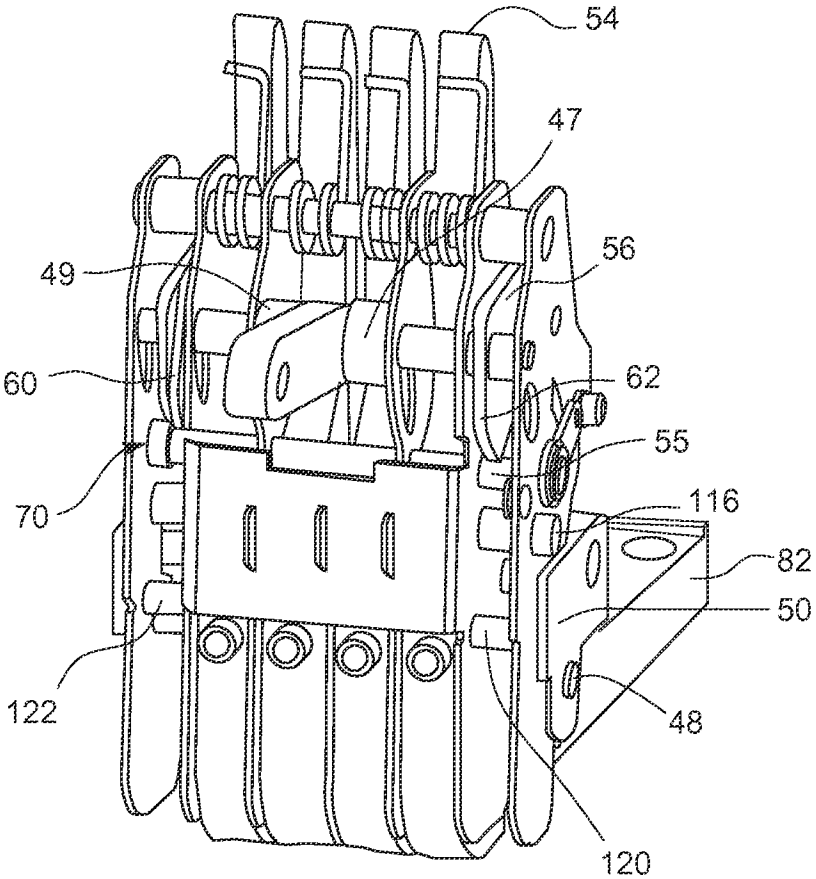
FIG. 3 is a perspective view of a moveable contact arm assembly operatively coupled to the carrier assembly with a retaining assembly operatively coupled thereto.
Figure 6:
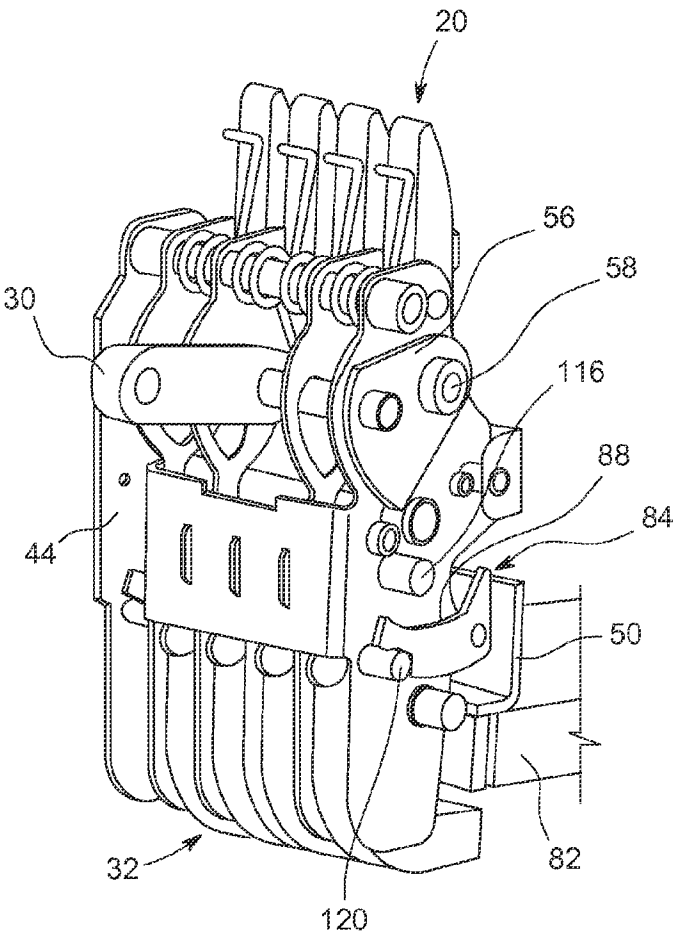
FIG. 6 is a perspective view of the retaining assembly in a latched position.
Figure 5:
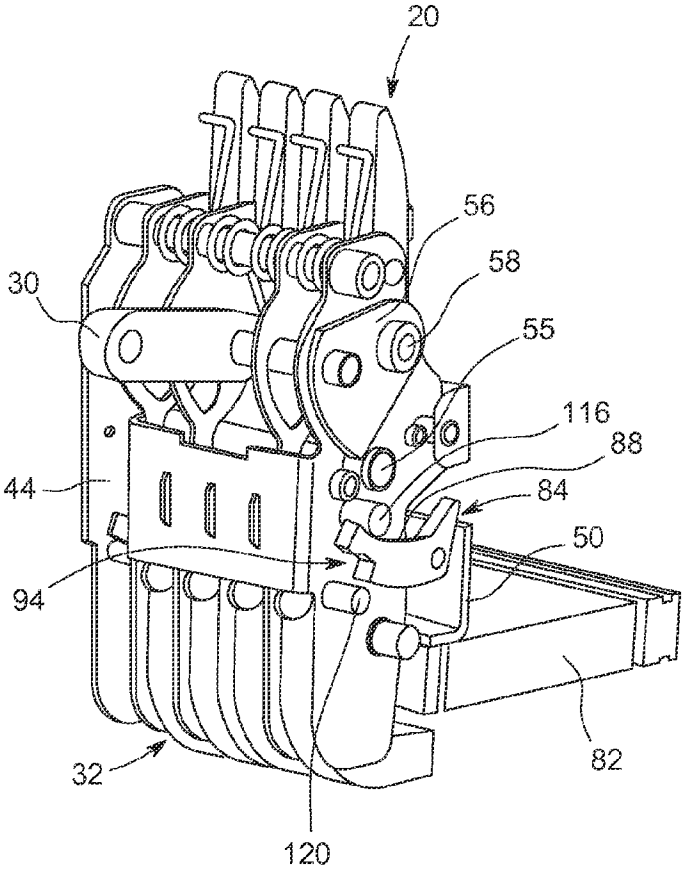
FIG. 5 is a perspective view of the retaining assembly in an unlatched position.

Referring now to FIGS. 2 and 3, movement of the plurality of moveable contact arms 20 is facilitated by a carrier assembly 32. The carrier assembly 32 includes a plurality of separation brackets 34. The plurality of separation brackets 34 may be independent brackets or may be formed as a uniform assembly, such as in an integrally formed or operatively coupled manner. In the illustrated embodiment, two of the separation brackets, referred to as a first end bracket 36 and a second end bracket 38, are integrally formed, joined by a U-bracket 40. Irrespective of the precise arrangement of the plurality of separation brackets 34, each of the brackets are disposed adjacent to at least one of the plurality of moveable contact arms 20 to separate the moveable contact arms 20. A first end plate 42 and a second end plate 44 are each disposed outwardly of the plurality of separation brackets 34. A second shaft 46 extends through the first end plate 42, the plurality of separation brackets 34, the second end plate 44, and the second coupling member 30. The second shaft 46 operatively couples the aforementioned components together and provides an axis about which the second coupling member 30 is rotatable about. As shown, additional shafts may be employed to further couple the components.

The second coupling member 30 is sized at the location of coupling to the second shaft 46 to be smaller than the space between the plurality of separation brackets 34 to avoid direct contact with the separation brackets. As shown best in FIG. 3, at least one spacer, such as a first spacer 47 and a second spacer 49 are disposed between the second coupling member 30 and the adjacent separation brackets. For example, the first spacer 47 is disposed between a first side of the second coupling member 30 and a first separation bracket and the second spacer 49 is disposed between a second side of the second coupling member 30 and a second separation bracket.

The plurality of moveable contact arms 20 are inserted between the plurality of separation brackets 34 and operatively coupled thereto by at least one shaft, such as a carrier shaft 48, which extends through the first end plate 42, the plurality of separation brackets 34, the second end plate 44, a bottom bracket 50, and the plurality of moveable contact arms 20. The plurality of moveable contact arms 20 is rotatable about the carrier shaft 48. In the illustrated embodiment, the axis about which the plurality of moveable contact arms 20 is rotatable about is located closer in proximity to a second end of each contact arm relative to a first end 54 of the contact arms. The moveable contact 22 disposed on each contact arm is located closer in proximity to the first end 54 in the illustrated embodiment.

As shown in FIGS. 2, 3, 5 and 6, a trip shaft 55 extends through the first end plate 42, the plurality of separation brackets 34, and the second end plate 44, and is free to rotate independently of the components through which it extends. Also included is a first latch plate 56 operatively coupled to the shaft 46 and positioned between the first end plate 42 and the first end bracket 36. One or more bushings 58 may be included on the first latch plate 56 to reduce tilting of the first latch plate 56. Although a single latch plate is contemplated, it is to be appreciated that a second latch plate 60 is provided in some embodiments, such as the illustrated embodiment. The second latch plate 60 is also operatively coupled to the shaft 46, but is positioned between the second end plate 44 and the second end bracket 38. Each of the latch plates pivot about the shaft 45 and may be formed of numerous contemplated geometries. In the illustrated embodiment, the latch plates 56, 60 are substantially wedge-shaped and have a curved end 62.

A latching assembly 70 includes the trip shaft 55, the first latch plate 56, and a portion of one of the plurality of moveable contact arms 20. As will be appreciated from the description herein, the latching assembly 70 retains the plurality of moveable contact arms 20 in the closed condition of the circuit breaker 10 and facilitates a rapid opening of the circuit breaker 10 by providing a system that is responsive to lower threshold currents during a short circuit event, thereby reducing the time required by the circuit breaker 10 to reach the open condition.

At least a portion of the trip shaft 55 is formed of a non-circular geometry cross-section, referred to herein as a non-circular region. The non-circular region includes an engagement surface that is disposed in contact with the first latch plate 56 (and second latch plate 60 in some embodiments) when the circuit breaker 10 is in the closed condition. Each of the plurality of moveable contact arms 20 includes a biasing portion in the form of a protrusion that is disposed in close proximity to non-circular region of the trip shaft 55 in the closed condition.

During operation of the circuit breaker, an electromagnetic force is generated at the contact location of the moveable contact 22 and the fixed contact 24, as described above. Upon reaching the predetermined threshold level, the electromagnetic force is sufficient to impart slight movement of the plurality of moveable contact arms 20. Upon such movement, the biasing portion of at least one of the plurality of moveable contact arms 20 pushes against the non-circular region of the trip shaft 55. It is contemplated that intermediate components may be included, such that the biasing portion indirectly contacts the trip shaft 55. In the illustrated embodiment, the non-circular region comprises a substantially semi-circular geometry, with the curved portion and a planar portion. In such an embodiment, the biasing portion contacts and pushes against the planar portion to impart rotation of the trip shaft 55. The rotation of the trip shaft 55 disengages the trip shaft 55 from the first latch plate 56 once the curved portion of the trip shaft 55 is no longer in contact with the first latch plate 56. Disengagement causes the carrier assembly 32 to fully rotate the moveable contact arm assembly 18 to a sufficient position that achieves the open condition of the circuit breaker 10.

Referring now to FIGS. 3-6, a retaining assembly 80 is illustrated. The retaining assembly 80 assists with preventing a "restrike" between the moveable contact 22 and the fixed contact 24 of the circuit breaker 10. As the above-described opening process occurs in response to a short circuit event, the carrier assembly 32, and therefore, the moveable contact arm assembly 20, moves with high velocity away from the respective fixed contacts, with a lower portion of the carrier assembly 32 potentially impacting a bottom terminal 82. Upon such an impact, the carrier assembly 32 tends to rebound off of the bottom terminal 82. It is desirable to avoid rebounding of the carrier assembly 32 to prevent the possibility of a restrike between the moveable contact 22 and the fixed contact 24. The retaining assembly 80 facilitates arrestment of the carrier assembly 32 to achieve the advantage of restrike avoidance.

The retaining assembly 80 includes at least one latch member and the above-described bottom bracket 50. In the illustrated embodiments, two latch members are included and will be referred to herein as a first latch member 84 and a second latch member 86. It is to be understood that embodiments having a single latch member or more than two latch members are contemplated. The latch members 84, 86 may be directly or indirectly coupled to the bottom bracket 50. In one embodiment, the latch members 84, 86 are riveted to the bottom bracket 50. Each of the latch members 84, 86 may have a biasing element, such as a spring, associated therewith to rotatably bias the latch members 84, 86 in a desired direction.

The first latch member 84 is positioned between the first end plate 42 and the first end bracket 36 and includes a first guiding surface 88 with multiple portions. In particular, a first portion 90 and a second portion 92 of the first guiding surface 88 are disposed at an angle to each other. The first latch member 84 also defines a first recess portion 94. The first recess portion 94 is located proximate a first end 96 of the first latch member 84, although embodiments with the recess portion at alternative locations along the first latch member 84 are contemplated. The first recess portion 94 is defined by a first tooth 98 and a second tooth 100 that are spaced from each other.

Similarly, the second latch member 86 is positioned between the second end plate 44 and the second end bracket 38 and includes a second guiding surface 102 with multiple portions. In particular, a first portion 104 and a second portion 106 of the second guiding surface 102 are disposed at an angle to each other. The second latch member 86 also defines a second recess portion 108. The second recess portion 108 is located proximate a first end 110 of the second latch member 86, although embodiments with the recess portion at alternative locations along the second latch member 86 are contemplated. The second recess portion 108 is defined by a first tooth 112 and a second tooth 114 that are spaced from each other.

A guide pin 116 is operatively coupled to, and extends from, the carrier assembly 32. In particular, the guide pin 116 extends from the first end bracket 36 of the carrier assembly 32 and is disposed in close proximity to, or in contact with, the first guiding surface 88, 102, respectively, when the circuit breaker 10 is in the closed condition or open condition In operation, upon movement of the carrier assembly 32 from the closed condition (FIG. 5) toward the open condition (FIG. 6) in response to a short circuit event, the guide pin 116 engages the guiding surfaces 88, 102, respectively. The first latch member 84 and the second latch member 86 are biased toward the guide pin 116 due to the biasing member, such as a torsion spring, as described above. The bottom bracket 50, and the end plates 42, 44 that it is coupled to, is fixed relative to the carrier assembly 32 that is moving during the short circuit event toward a "blow open" condition. As the guide pins 116 travels along the guiding surfaces 88, 102 to a location corresponding to the second portions 92, 106 the latch members 84, 86 are pivoted relative to the bottom bracket 50. This is based on the angular orientation of the portions of the guiding surfaces 88, 102.

Once the carrier assembly 32 begins to rebound after contacting the bottom terminal 82, the latch members 84, 86 are positioned with the recess portions 94, 108 at least partially surrounding respective stop pins. The stop pins are referred to herein as a first stop pin 120 and a second stop pin 122. The first stop pin 120 is operatively coupled to, and extends from, the first end plate 42 and is positioned to be retained by the first recess portion 94 of the first latch member 84 at the rebound position of the carrier assembly 32. The second stop pin 122 is operatively coupled to, and extends from, the second end plate 44 and is positioned to be retained by the second recess portion 108 of the second latch member 86 at the rebound position of the carrier assembly 32. Specifically, the teeth 98, 100, 112, 114 of the latch members 84, 86 prevent the carrier assembly 32 from rebounding to an extent sufficient to possibly cause a restrike between the moveable contact 22 and the fixed contact 24, thereby avoiding damage associated therewith.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A retaining assembly of a circuit breaker contact system comprising:

a fixed contact;

at least one moveable contact arm assembly comprising a moveable contact arm having a moveable contact thereon and moveable with the moveable contact arm, the moveable contact arm moveable to position the moveable contact into engagement with the fixed contact to define a closed condition and out of engagement with the fixed contact to define a blow open condition;

a carrier assembly operatively coupled to the moveable contact arm;

a first end plate operatively coupled to the carrier assembly;

a bottom bracket operatively coupled to the first end plate;

a first latch member pivotably coupled to the bottom bracket, the first latch member comprising a first guiding surface and defining a first recess portion;

a guide pin operatively coupled to, and extending from, the carrier assembly, the guide pin in contact with the first guiding surface of the first latch member during movement of the moveable contact arm assembly from the closed condition to the blow open condition; and a first stop pin operatively coupled to, and extending from, the carrier assembly, the first stop pin disposed in the first recess portion of the first latch member in the blow open condition of the circuit breaker.

2. The retaining assembly of claim 1, further comprising:

a second end plate operatively coupled to the carrier assembly; and a second latch member pivotably coupled to the bottom bracket, the first latch member disposed between the first end plate and the carrier assembly, and the second latch member disposed between the second end plate and the carrier assembly.

3. The retaining assembly of claim 1, further comprising a torsion spring disposed to bias the first latch member toward the guide pin.

4. The retaining assembly of claim 1, wherein the first guiding surface of the first latch member includes an angled portion operative to pivot the first latch member toward the first stop pin during movement of the moveable contact arm assembly toward the blow open condition.

5. The retaining assembly of claim 1, wherein the first latch member is fastened to the bottom bracket.

6. The retaining assembly of claim 1, wherein the moveable contact arm comprises a first end and a second end, the moveable contact arm pivotable about an axis located proximate the second end.

7. The retaining assembly of claim 6, wherein the moveable contact disposed on the moveable contact arm is located closer in proximity to the first end than the second end of the moveable contact arm.

8. The retaining assembly of claim 6, wherein the carrier assembly is operatively coupled to the moveable contact arm with a carrier shaft positioned coaxially with the axis.

9. The retaining assembly of claim 1, wherein the first end plate is located at a first side of the carrier assembly and the second end plate is located at a second side of the carrier assembly.

10. The retaining assembly of claim 9, further comprising:

a second end plate operatively coupled to the carrier assembly;

a second latch member pivotably coupled to the bottom bracket and comprising a second guiding surface and a second recess portion;

the guide pin operatively coupled to, and extending from, the second side of the carrier assembly, the guide pin in contact with the second guiding surface of the second latch member during movement of the moveable contact arm assembly from the closed condition to the blow open condition; and a second stop pin operatively coupled to, and extending from, the carrier assembly, the second stop pin disposed in the recess portion of the second latch member in the blow open condition of the circuit breaker to prevent movement of the moveable contact arm assembly toward the closed condition;

the first latch member disposed between the first end plate and the first side of the carrier assembly;

the second latch member disposed between the second end plate and the second side of the carrier assembly.

11. A circuit breaker having a mechanism portion, a contact system portion and an arc chamber portion, the circuit breaker comprising:

a plurality of fixed contacts;

a moveable contact arm assembly comprising a plurality of moveable contact arms, each of the plurality of moveable contact arms having a moveable contact disposed thereon and moveable with the plurality of moveable contact arms, the moveable contact arm moveable to position each moveable contact into engagement with a respective fixed contact of the plurality of fixed contacts to define a closed condition and out of engagement with the plurality of fixed contacts to define a blow open condition;

a carrier assembly operatively coupling the plurality of moveable contact arms to each other, the carrier assembly comprising a plurality of separation brackets operatively coupled to each other, each of the plurality of separation brackets disposed adjacent at least one of the plurality of moveable contact arms;

a first end plate operatively coupled to a first side of the carrier assembly;

a second end plate operatively coupled to a second side of the carrier assembly;

a bottom bracket operatively coupled to the first end plate and the second end plate;

a first latch member pivotably coupled to the bottom bracket, the first latch member comprising a first guiding surface and defining a first recess portion;

a guide pin operatively coupled to, and extending away from, the first side of the carrier assembly, the guide pin in contact with the first guiding surface of the first latch member during movement of the moveable contact arm assembly from the closed condition to the blow open condition;

a first stop pin operatively coupled to, and extending away from, the first side of the carrier assembly, the first stop pin disposed in the first recess portion of the first latch member in the blow open condition of the circuit breaker;

a second latch member pivotably coupled to the bottom bracket, the second latch member comprising a second guiding surface and defining a second recess portion;

the guide pin operatively coupled to, and extending away from, the second side of the carrier assembly, the guide pin in contact with the second guiding surface of the second latch member during movement of the moveable contact arm assembly from the closed condition to the blow open condition; and a second stop pin operatively coupled to, and extending away from, the second side of the carrier assembly, the second stop pin disposed in the second recess portion of the second latch member in the blow open condition of the circuit breaker to prevent movement of the moveable contact arm assembly toward the closed condition.

12. The circuit breaker of claim 11, further comprising a first spring disposed to bias the first latch member toward the guide pin and a second spring disposed to bias the second latch member toward the guide pin.

13. The circuit breaker of claim 11, wherein the first guiding surface and the second guiding surface each include an angled portion operative to pivot the first latch member and the second latch member toward the first stop pin and the second stop pin, respectively, during movement of the moveable contact arm assembly toward the blow open condition.

14. The circuit breaker of claim 11, wherein the first latch member and the second latch member are each fastened to the bottom bracket.

15. The circuit breaker of claim 11, wherein each of the plurality of moveable contact arms comprises a first end and a second end, the plurality of moveable contact arms pivotable about an axis located proximate the second end.

16. The circuit breaker of claim 15, wherein the moveable contact disposed on each of the plurality of moveable contact arms is located closer in proximity to the first end than the second end.

17. The circuit breaker of claim 15, wherein the carrier assembly is operatively coupled to the plurality of moveable contact arms with a carrier shaft positioned coaxially with the axis.

* * * * *